US006648990B2

(12) United States Patent
Yoshizawa

(10) Patent No.: US 6,648,990 B2
(45) Date of Patent: Nov. 18, 2003

(54) CO-BASED MAGNETIC ALLOY AND MAGNETIC MEMBERS MADE OF THE SAME

(75) Inventor: Yoshihito Yoshizawa, Fukaya (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 10/084,200

(22) Filed: Feb. 28, 2002

(65) Prior Publication Data

US 2002/0189718 A1 Dec. 19, 2002

(30) Foreign Application Priority Data

Mar. 1, 2001 (JP) ..... 2001-056627

(51) Int. Cl.[7] ..... H01F 1/147
(52) U.S. Cl. ..... 148/313; 420/435
(58) Field of Search ..... 148/313; 420/435

(56) References Cited

U.S. PATENT DOCUMENTS 4,056,411 A * 11/1977 Chen et al. ..... 148/101

5,151,137 A * 9/1992 Yoshizawa et al. ..... 148/108

* cited by examiner

*Primary Examiner*—John Sheehan
(74) *Attorney, Agent, or Firm*—Sughrue Mion, PLLC

(57) ABSTRACT

Disclosed is a Co-base magnetic alloy excellent in high-frequency magnetic properties, of which chemical composition is represented by the following general formula, by atomic %, $(Co_{1-a}Fe_a)_{100-y-c}M'_yX'_c$, where M' is at least one element selected from the group consisting of V, Ti, Zr, Nb, Mo, Hf, Sc, Ta and W; X' is at least one element selected from the group consisting of Si and B; and a, y and c are defined by the formulas of $a<0.35$, $1.5 \leqq y \leqq 15$, and $4 \leqq c \leqq 30$, respectively. At least a part of the alloy structure of the alloy consists of crystal grains having an average grain size of not more than 50 nm. The alloy has a relative initial permeability of not more than 2000. It is suitably used for members of countermeasure against noise such as zero phase reactors for large current and electromagnetic shielding materials, inverter transformers, choke coils for active filters, antennas, smoothing choke coils, power supplies for lasers, pulse power magnetic members for accelerators.

14 Claims, 7 Drawing Sheets

CO-BASED MAGNETIC ALLOY AND MAGNETIC MEMBERS MADE OF THE SAME

BACKGROUND OF THE INVENTION

1. Field of the Invention

The present invention relates to a Co-base magnetic alloy having excellent high-frequency magnetic properties, which is used in members of countermeasure against noise such as zero phase reactors and electro-magnetic shielding materials, inverter transformers, choke coils for active filters, antennas, smoothing choke coils, saturable reactors, power supplies for laser, pulse power magnetic members for accelerators, and so on. It also relates to high performance magnetic members made of the Co-base magnetic alloy.

2. Description of the Prior Art

Ferrite, amorphous alloys, nano-granular thin film materials, and so on have been known as magnetic materials for high frequency applications. The ferrite materials are unsuitable for high power applications in a high frequency range in which an operating magnetic flux density increases and a temperature rises, because the ferrite materials exhibit low saturation magnetic flux density and inferior temperature characteristics.

Because of large magnetostriction, Fe-base amorphous alloys have problems that magnetic properties are deteriorated under stress and that a large noise is generated in a use, wherein, for example, currents of an audio-frequency range are superimposed.

On the other hand, a Co-base amorphous alloy is thermally unstable. Therefore, if the Co-base amorphous alloy, which exhibits good properties for high-frequency applications, is used in applications which requires a high power, there will arise a problem that high-frequency magnetic properties are deteriorated because a large property change against time occurs.

An Fe-base nanocrystalline alloy is excellent in soft magnetic properties. Therefore, it is used for a magnetic core of common mode choke coils, high-frequency transformers, pulse transformers, etc. As typical alloy compositions thereof, there have been known an Fe—Cu—(Nb, Ti, Zr, Hf, Mo, W, Ta)—Si—B alloy, Fe—Cu—(Nb, Ti, Zr, Hf, Mo, W, Ta)—B alloy, and so on which are disclosed in JP-B2-4-4393 (corresponding to U.S. Pat. No. 4,881,989) and JP-A-242755. In general, these Fe-base nanocrystalline alloys are prepared by nanocrystalizing amorphous alloys by annealing, which are fabricated by quenching an alloy from a liquid phase or a gaseous phase. A single roll method, a twin roll method, a centrifugal quenching method, a method of rotary spinning in a liquid, an atomizing process, and a cavitation method are known as typical rapid quenching methods from the liquid phase. Further, known examples of rapid quenching methods from the gaseous phase include a sputtering method, a vapor deposition method, an ion plating method, and so on.

The Fe-base nanocrystalline alloy is prepared by nanocrystalizing the amorphous alloy prepared by the above methods by annealing, which is thermally stable not like as an amorphous alloy, and which has been known that it exhibits high saturation magnetic flux density which is substantially the same as those of the Fe-base amorphous alloy, and exhibits excellent soft magnetic properties and low magnetostriction. Further, it has been known that the nanocrystalline alloy exhibits a small property change against time and also excellent temperature characteristics.

When the Fe-base nanocrystalline soft magnetic alloy is compared with a conventional soft magnetic material having generally the same saturation magnetic flux density, the alloy exhibits higher magnetic permeability and lower magnetic core loss, so that it is excellent in soft magnetic properties. However, an optimum operating frequency range for use in the transformer is around several tens of kilohertz for thin strip materials, and the properties are not sufficient for applications in the high frequency. Moreover, when the alloy is used as members of counter-measure against noise, particularly a large effect is obtained at 1 MHz or less. Therefore, there has been a demand for materials superior in the property even in a higher frequency range. With regard to the members of countermeasure against noise for the high current, it is necessary to prevent the saturation of the magnetic core and the unstable operation. From this viewpoint, there has been a demand for a material which indicates a magnetization curve with a low squareness ratio and exhibits a superior property in a high-frequency range. In these uses, a high-permeability material having a relative magnetic permeability of several tens of thousands in a low-frequency region has a problem that the magnetic core material is magnetically saturated and that a sufficient property cannot be obtained in the high frequency range.

With regard to a magnetic switch for use in a saturable reactor, accelerator, and so on, there has been a demand for a magnetic core material which has a high squareness ratio and low magnetic core loss in order to improve controllability, compression ratio, and efficiency.

In order to solve the above problems, a thin film for reducing an eddy current loss, a high electric resistance granular thin film, and so on have been examined. However, the granular thin film with high electric resistance has a limitation in increasing a volume of the magnetic material, and it is difficult to use the thin film as the magnetic core material for a magnetic switch, transformer, choke coil, and so on in a pulse power applications handling a high energy and a large-capacity inverter.

Therefore, even for the thin strip material whose volume is easily increased, or a bulk material, there has been a strong demand for a material superior in the magnetic property in a higher frequency range as the magnetic core material.

The Fe-base nanocrystalline soft magnetic alloy manufactured by crystallizing an amorphous alloy thin strips by the heat treatment generally shows a high magnetic permeability in a frequency range of several hundreds of kilohertz or less, and exhibits a rather high value of a quality factor Q as one of important properties of the material for coil members. However, a sufficiently high Q cannot be obtained in a megahertz (MHz) or higher range, even when the alloy is heat-treated in a magnetic field and a magnetic anisotropy is induced in the alloy. Moreover, there are problems of a magnetic saturation of the material by superimposed direct-current or by an unbalanced signal, when the material is used in the choke coil for a three-phase power line.

As the Co-base nanocrystalline alloy, an alloy disclosed in JP-A-3-249151 (corresponding to U.S. Pat. No 5,151,137) is known. However, the disclosed alloy contains a large amount of borides. There are problems that even with the heat treatment in the magnetic field, a high Q in the high frequency range, and a sufficiently low squareness ratio, or a sufficiently high squareness ratio cannot be obtained.

SUMMARY OF THE INVENTION

To solve the above problems, as a result of intensive studies, the present inventors have found a Co-base magnetic alloy which has excellent high-frequency magnetic properties in the megahertz (MHz) range.

The Co-base magnetic alloy has a chemical composition represented by the following general formula, by atomic %: $(Co_{1-a}Fe_a)_{100-y-c}M'_yX'_c$, where M' is at least one element selected from the group consisting of V, Ti, Zr, Nb, Mo, Hf, Sc, Ta and W; X' is at least one element selected from the group consisting of Si and B; and a, y and c satisfy the formulas of $a<0.35$, $1.5\leqq y\leqq 15$, and $4\leqq c\leqq 30$, respectively. At least a part of the alloy structure of the Co-base magnetic alloy consists of crystal grains having an average grain size of not more than 50 nm. The present invention is based on finding that the above Co-base magnetic alloy, having a relative initial permeability of not more than 2000, exhibits excellent high frequency magnetic characteristics in the megahertz (MHz) range.

The Co-base magnetic alloy is prepared by quenching a molten metal having the above chemical composition by means of a rapid quenching technique such as a single roll method to produce an amorphous alloy. The amorphous alloy is subjected to working and heat treatment at a crystallization temperature or a higher temperature to form fine crystal grains having an average grain size of not more than 50 nm. The amorphous alloy prior to the heat treatment preferably has no crystalline phase, but may partially include the crystalline phase. The heat treatment is usually performed in inert gases such as an argon gas, nitrogen gas, or helium gas, and so on. A magnetic field having an intensity enough for saturating the alloy is applied during at least a part of a heat treatment period, the heat treatment is performed in the magnetic field, and a magnetic anisotropy is induced. The magnetic field strength depends on a shape of a magnetic alloy core. However, in general, when the magnetic field is applied in a width direction of a thin strip (in a height direction of a wound magnetic core), a magnetic field of 8 kA/m or more is applied. When the heat treatment is performed under magnetic field applied along a magnetic path direction, a magnetic field of about 8 A/m or more is applied. Any one of a direct-current, alternating-current, and repeated pulse magnetic fields may be used as the applied magnetic field. The magnetic field is applied in a temperature range of 300° C. or more usually for 20 minutes or more. When a magnetic field is applied during heating, at a constant temperature, and during cooling, the quality factor Q in the high frequency range, or a squareness ratio is improved, whereby a satisfactory result is obtained. On the other hand, when the heat treatment is performed without magnetic field, that is, when the heat treatment in the magnetic field is not applied, the high-frequency magnetic property is deteriorated. The heat treatment is preferably performed in the inert gas atmosphere whose dew point is usually −30° C. or less. When the heat treatment is performed in the inert gas atmosphere having a dew point of −60° C. or less, a variance of properties is small and a more satisfactory result is obtained. A maximum reaching temperature during the heat treatment is equal to or higher than a crystallization temperature, and is usually in a range of 450° C. to 700° C. In the case of a heat treatment pattern for keeping the alloy at a constant temperature, a keeping time at the constant temperature is usually not longer than 24 hours, preferably not longer than 4 hours, from the viewpoint of productivity. An average heating rate during the heat treatment is preferably 0.1° C./min to 200° C./min, more preferably 0.1° C./min to 100° C./min, an average cooling rate is preferably 0.1° C./min to 3000° C./min, more preferably 0.1° C./min to 100° C./min, and an alloy superior particularly in the high-frequency magnetic property is obtained in this range. The heat treatment is not limited to one step, and multi-step heat treatment or a plurality of heat treatments can also be performed. Furthermore, when a direct-current, alternating-current or pulse current is passed through the alloy, the alloy is allowed to generate heat and can also be heat-treated.

According to the above-described process, it is easy to provide the invention alloy with a relative initial permeability of not more than 2000. It is also possible for the invention alloy to have properties of not less than 4 of the quality factor Q at 1 MHZ, and a squareness ratio $B_r/B_{8000}$ of 20% or less. According to another embodiment of the invention, it is easily possible to provide the invention alloy with a squareness ratio $B_r/B_{8000}$ of not less than 85% by changing the orientation of magnetic field applied to the thin strip during heat treatment from the width direction to a longitudinal direction of the thin strip. Here, $B_{8000}$ denotes a magnetic flux density with application of a magnetic field of 8000 $Am^{-1}$. Particularly, in the case of the a relative initial permeability of not more than 1000, the quality factor Q becomes particularly high, so that a good result can be obtained.

In the present invention, an Fe content ratio needs to be $a<0.35$. When a is 0.35 or more, a sufficient induced magnetic anisotropy cannot be obtained. When a magnetic field sufficient for saturating the alloy is applied in a direction substantially perpendicular to a magnetization direction during use and the heat treatment is performed, a considerable decrease of Q in 1 MHz occurs. Moreover, when the magnetic field sufficient for saturating the alloy is applied in generally the same direction as the magnetization direction during use and the heat treatment is performed, and when a is 0.35 or more, the squareness ratio is liable to drop unfavorably. A particularly preferable range is $a<0.2$. In this range, a magnetostriction is small, a high Q or a high squareness ratio is obtained, property deterioration due to stress is reduced, so that more preferable results can be obtained. The elements M' and X' promote amorphous formation. The element M' is at least one element selected from V, Ti, Zr, Nb, Mo, Hf, Sc, Ta and W, an M' amount y is in a range of $1.5\leqq y\leqq 15$, and an X' amount c is in a range of $4\leqq c\leqq 30$. When y is less than 1.5 atomic %, a fine crystal grain structure is not obtained after the heat treatment, and unfavorably a high Q is not obtained. When y exceeds 15 atomic %, the temperature property is disadvantageously deteriorated. The element X' is at least one element selected from Si and B. When the X' amount c is less than 4 atomic %, the crystal grains after the heat treatment is not easily finely divided. When c exceeds 30 atomic %, the saturation magnetic flux density disadvantageously decreases. Particularly, when a B (boron) content is from 4 to 15 atomic %, the induced magnetic anisotropy increases and an excellent property of a high Q or a high squareness ratio can be obtained.

A remaining part of the crystal grains having the average grain size of not more than 50 nm is mainly an amorphous phase. With a larger ratio of crystal grains, the induced magnetic anisotropy increases, and the quality factor Q at a higher-frequency is improved. However, the amorphous phase, which is partially present, realizes a high resistivity, the ultra-fine crystal grains, a good soft magnetic property, whereby a satisfactory result can be obtained.

With regard to the invention alloy, if necessary, the surface of the alloy thin strip is coated with particles or films of $SiO_2$, MgO, $Al_2O_3$, and so on, the surface is treated by a formation treatment, an oxide layer is formed on the surface by an anode oxidation treatment, and an interlayer insulation treatment is performed. Then, a more satisfactory result is obtained. This particularly reduces an influence of an eddy current in a high frequency extending among the layers, and effectively improves the properties such as Q in the high frequency range and magnetic core loss. This effect is remarkable, when the alloy is used for a magnetic core made of a thin strip having a satisfactory surface state and a broad width. Furthermore, when the magnetic core is prepared using the invention alloy, impregnation, coating, and so on can also be performed as the occasion demands. The invention alloy can fulfill capabilities most for use in the high frequency range, but can also be used in a sensor or a low-frequency magnetic member. Particularly, the alloy can fulfill superior properties, when the member is easily magnetically saturated.

For the invention alloy subjected to the heat treatment while the magnetic field is applied in the direction substantially perpendicular to the magnetization direction during the use, the high Q is obtained in the high frequency even with the thin strip, as compared with a conventional thin strip material. Moreover, the superior properties can similarly be obtained even with the thin film or the powder. The quality factor Q is represented by a ratio of a real part $\mu'$ of the magnetic permeability to an imaginary part $\mu''$ of the magnetic permeability. The factor is one of the properties indicating the capabilities of the magnetic core material in the high frequency. When the material having a higher Q is used in the coil member, the loss is reduced and the properties are improved.

A static B-H loop of a hard magnetization axis direction of the Co-base magnetic alloy according to the present invention has a flat inclined shape, and usually has an anisotropic magnetic field $H_K$ of 950 $Am^{-1}$ or more. Even when a large magnetic field is applied to the present alloy, the material is not easily magnetically saturated, and the alloy is suitable for use in the high power. The relative initial permeability is about not more than 2000, and decreases little and exhibits a flat frequency dependence even in a high frequency range, as compared with a conventional nanocrystalline alloy thin strip having the same strip thickness.

In the present invention, 10 atomic % or less of a total amount of Co and Fe may be replaced with at least one element selected from the group of Cu and Au. With the replacement with Cu, Au, the crystal grains are more finely divided, and the high-frequency magnetic property is further improved. A particularly preferable replacement amount is $0.1 \leqq x \leqq 3$ (atomic %). In this range, the alloy can easily be manufactured, and particularly superior high-frequency magnetic properties such as the high Q can be obtained.

In the invention alloy, Co may be partially replaced with Ni, whereby it is possible to improve the corrosion resistance of the alloy and adjust the induced magnetic anisotropy of the alloy.

Moreover, in the invention alloy, M' may partially be replaced with at least one element selected from Cr, Mn, Sn, Zn, In, Ag, platinum group elements, Mg, Ca, Sr, Y, rare earth elements, N, O and S. Since M' is partially replaced with at least one element selected from Cr, Mn, Sn, Zn, In, platinum group elements, Mg, Ca, Sr, Y, rare earth elements, N, O and S, effects such as improvement of the corrosion resistance, enhancement of the resistivity, and adjustment of the magnetic property can be obtained. Particularly, the platinum group elements such as Pd and Pt can enhance the induced magnetic anisotropy, and can improve the properties such as Q in the higher-frequency range.

Moreover, X' may partially be replaced with at least one element selected from C, Ge, Ga, Al and P. By such a replacement, effects such as adjusted magnetostriction and fine crystal grains can be obtained.

A part of the invention alloy is of a structure of crystal grains having an average grain size of not more than 50 nm. A ratio of the crystal grains in the alloy structure is preferably 30% or more, more preferably 50% or more, particularly preferably 60% or more. A particularly preferable average crystalline grain size is in a range of 2 nm to 30 nm. In this range, a particularly high Q is obtained in a high frequency of 1 MHz or more.

The above mentioned crystal grains formed in the invention alloy are mainly of a crystalline phase primarily containing Co, in which Si, B, Al, Ge, Zr, etc. may be also dissolved. The crystalline phase may also contain an ordered lattice. The residual part other than the crystalline phase is mainly an amorphous phase. An alloy consisting essentially of only the crystalline phase may be also included in the present invention. With the alloy containing Cu or Au, a face-centered cubic structure phase (fcc phase) partially including Cu or Au may be sometimes present.

Moreover, when the amorphous phase is present around the crystal grains, the resistivity increases. By suppression of crystalline grain growth, the crystal grains are finely divided, the soft magnetic properties are improved, and therefore a more satisfactory result is obtained.

When a compound phase is not present in the invention alloy, more superior high-frequency magnetic properties are obtained.

Further, in the invention alloy, when at least a part or all of the crystal grains having an average grain size of not more than 50 nm are crystal grains having a body-centered cubic structure (bcc), the induced magnetic anisotropy is increases and a particularly superior high-frequency magnetic properties are obtained. In the invention alloy, at least a part or all of the crystal grains having an average grain size of not more than 50 nm may be crystal grains having a face-centered cubic structure (fcc), and superior soft magnetic properties and low magnetostriction are obtained. In the invention alloy, at least a part or all of the crystal grains having an average grain size of not more than 50 nm may include hexagonal (hcp) crystal grains.

According to another aspect of the present invention, there is provided magnetic members consisting of the above Co-base magnetic alloy. The wound magnetic cores or laminated magnetic cores made of the invention alloy with a conductive wire realize high performance transformers, choke coils or inductors, which exhibit a high Q in the high frequency range. The invention alloy is suitable for members of countermeasure against noise, since a sheet made of the invention alloy exhibits a high Q in the high-frequency range. When the alloy is used as cores for tuning type high-frequency accelerators, they exhibit superior properties. A magnetic members made of the Co-base magnetic alloy having a high squareness ratio can realize the superior properties as a magnetic switch core, etc.

DESCRIPTION OF THE PREFERRED EMBODIMENT

The present invention will be described hereinafter in terms of examples, but the present invention is not limited to these examples.

Example 1

A molten alloy of $(Co_{0.81}Fe_{0.91})_{bal.}Cu_1Nb_3Si_{15.5}B_{6.5}$ (atomic %) was rapidly quenched in the single roll method to obtain an amorphous alloy thin strip having a width of 5 mm and thickness of 18 $\mu$m. The amorphous alloy thin strip was wound into a toroidal magnetic core with an outer diameter of 19 mm and an inner diameter of 15 mm.

Figure 1:
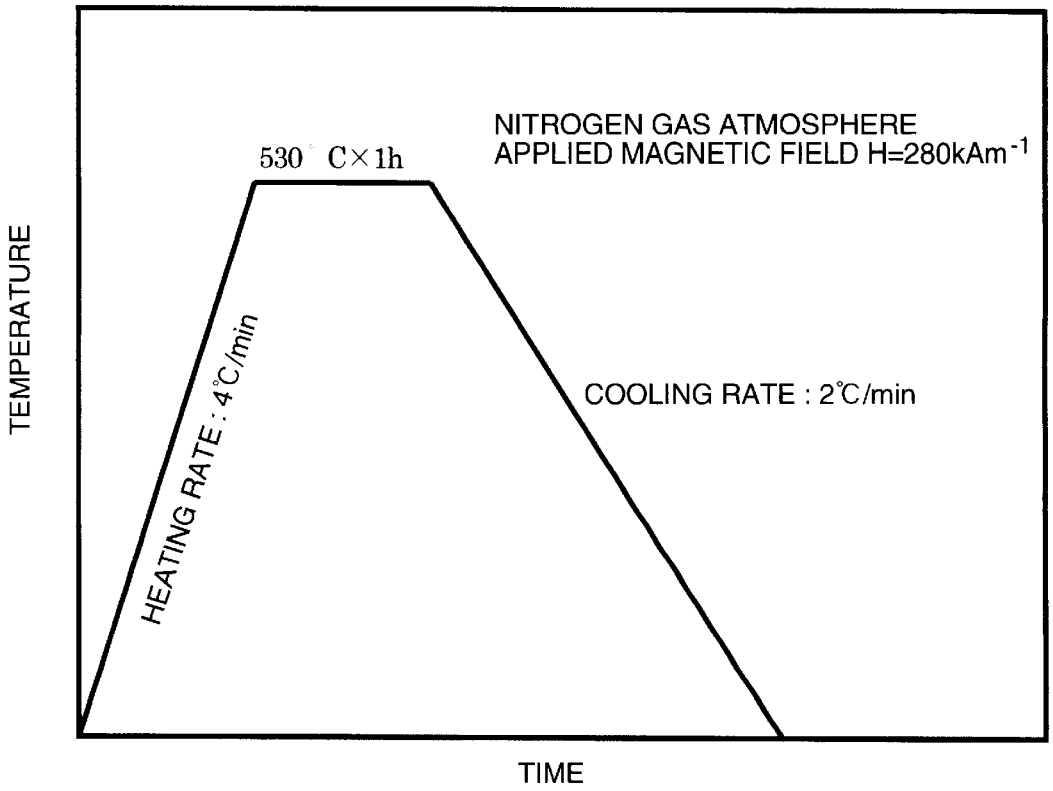
FIG. 1 shows one example heat treatment pattern according to the present invention.
Figure 2:
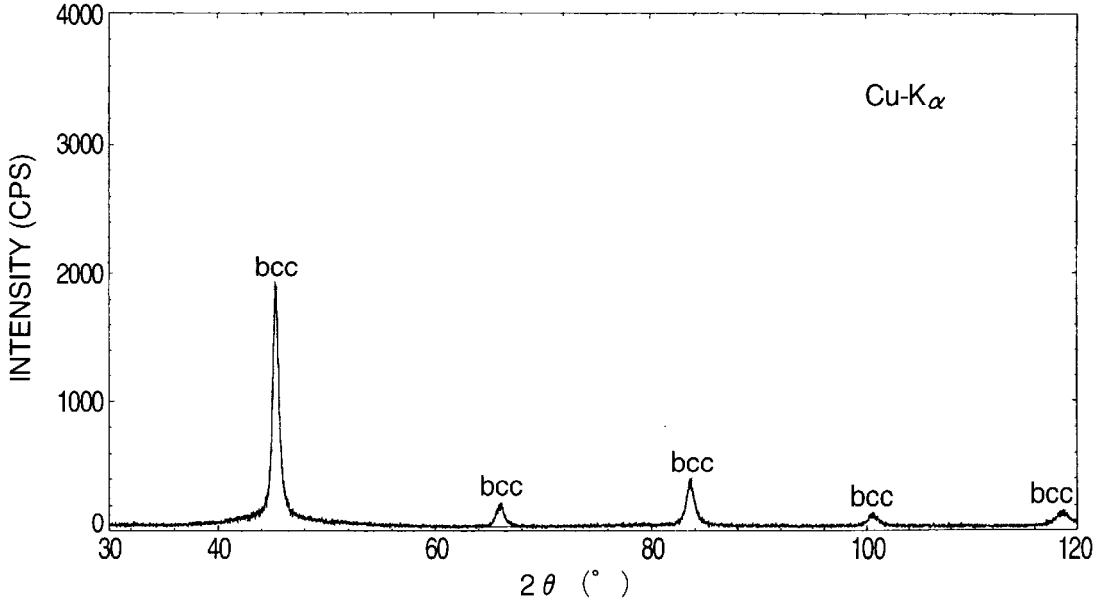
FIG. 2 shows one example X-ray diffraction pattern of the invention alloy.

The prepared magnetic core was inserted in a heat treatment furnace having a nitrogen gas atmosphere in order to subject it to heat treatment in accordance with the heat treatment pattern shown in FIG. 1. During the heat treatment, a magnetic field of 280 $kAm^{-1}$ was applied in a direction perpendicular to a magnetic path of the magnetic alloy core (in a width direction of the alloy thin strip), that is, a height direction of the magnetic core. The heat-treated alloy was crystallized. According to an observation with an electron microscope, most of the alloy structure was composed of fine crystal grains of a body-centered cubic structure having a grain size of about 20 nm, and a volume fraction of the crystal grains was estimated to be about 65%. Most of crystalline phase was of the body-centered cubic structure. A remaining matrix phase mainly has an amorphous phase. FIG. 2 shows an X-ray diffraction pattern. A crystalline peak indicating the phase of the body-centered cubic structure can be seen, but a peak of a compound phase can not be seen from the X-ray diffraction pattern.

Figure 3:
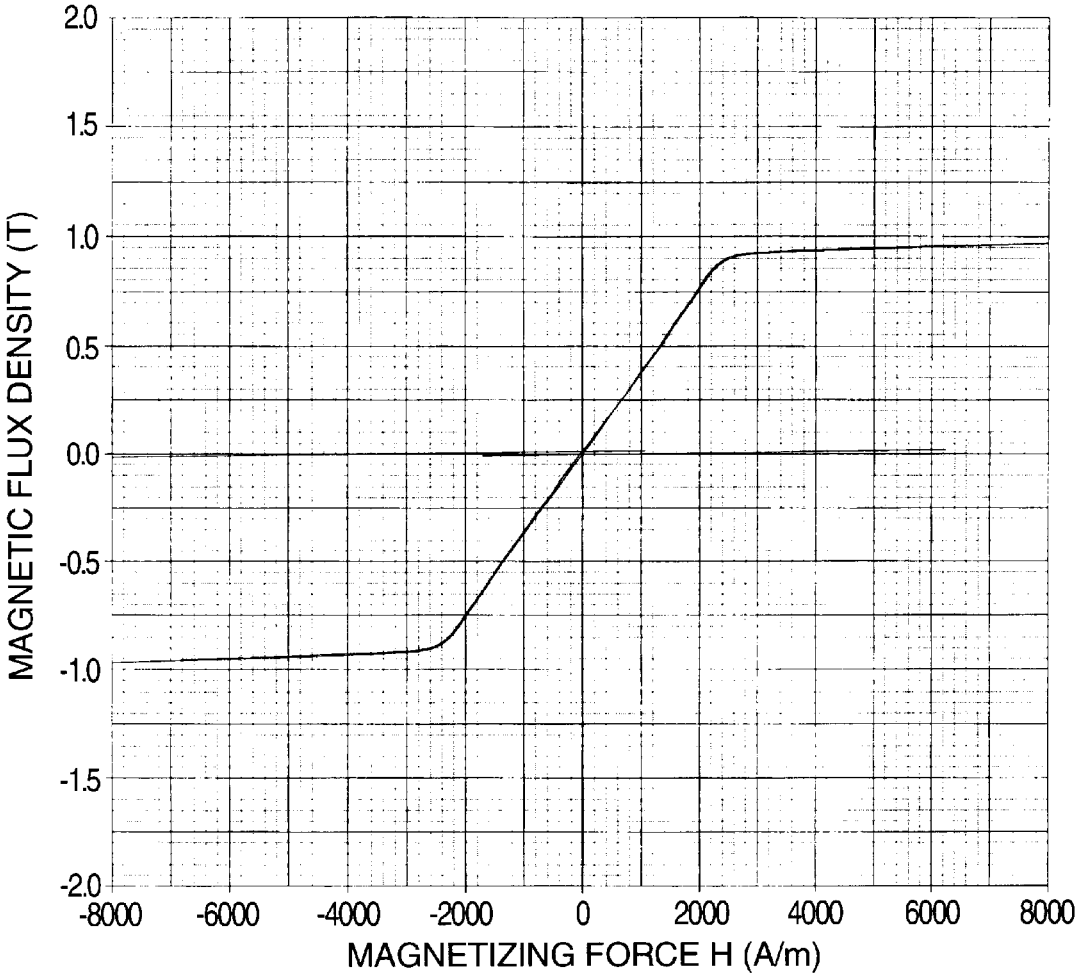
FIG. 3 shows one example static B-H loop of the invention alloy.

Subsequently, a static B-H loop of the magnetic alloy core, and a quality factor Q ($=\mu'/\mu''$) at 1 MHz were measured. FIG. 3 shows the static B-H loop, and Table 1 shows obtained results. For a comparison purpose, properties of a $Fe_{bal.}Cu_1Nb_3Si_{15.5}B_{6.5}$ alloy, which is a non-invention alloy and which was subjected to substantially the same heat treatment as the above, are also shown in Table 1. With regard to the magnetic core of the invention alloy, $B_{8000}$ is 0.97T, an alternating-current relative initial permeability $\mu_{riac}$ at 1 MHz is 270, $B_r/B_{8000}$ is 1%, and Q at 1 MHz is 18. The invention alloy exhibits a higher Q in the high frequency range, a low squareness ratio, and not easily saturated B-H loop as compared with the non-invention alloy. Therefore, the invention alloy is suitable for cores for high-frequency accelerators or coil parts for countermeasure against noise. Further, the invention alloy has a core loss of 260 $kWm^{-3}$ at 100 kHz, 0.2T and also has a fully low magnetic core loss of several hundreds of kilohertz or less, so that it can be applied to transformers or choke coils used under several hundreds kilohertz or less. On the other hand, the conventional alloy has a lower Q value than the invention alloy, so that the former alloy is inferior to the latter alloy.

Example 2

A molten alloy having a composition represented by the general formula $(Co_{1-a}Fe_a)_{bal.}Cu_{0.6}Nb_{2.6}Si_9B_9$ (atomic %) was quenched in the single roll method to obtain a thin amorphous alloy strip having a width of 5 mm and thickness of 18 $\mu$m. The thin amorphous alloy strip was wound into a toroidal magnetic core with an outer diameter of 19 mm and an inner diameter of 15 mm.

Figure 4:
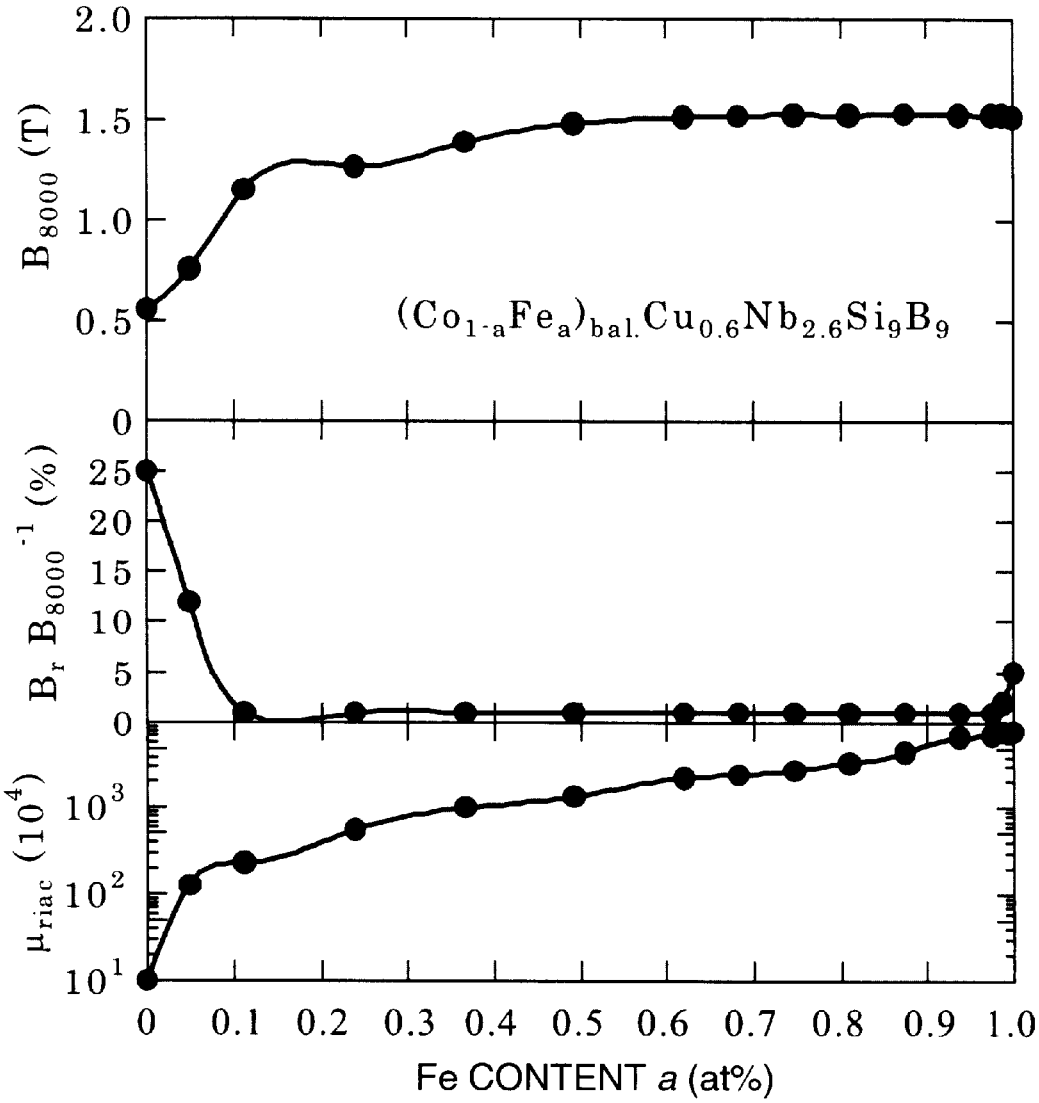
FIG. 4 is a diagram showing Fe content dependence of a saturation magnetic flux density $B_s$, squareness ratio $B_r/B_{8000}$, and relative initial permeability $\mu_i$ for the invention alloy.
Figure 5:
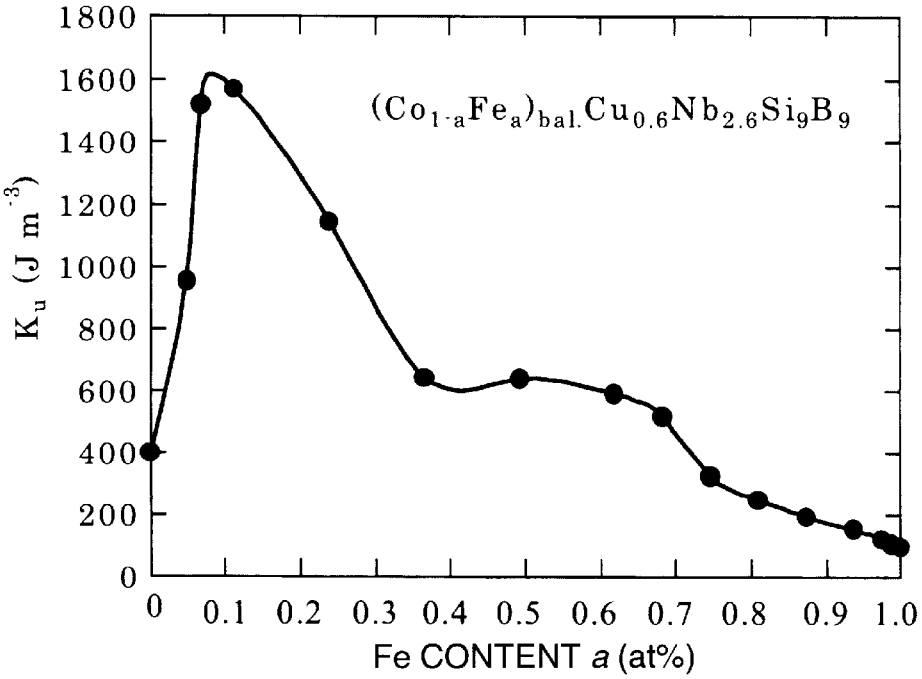
FIG. 5 is a diagram showing Fe content dependence of an induced magnetic anisotropy constant $K_u$ for the invention alloy.
Figure 6:
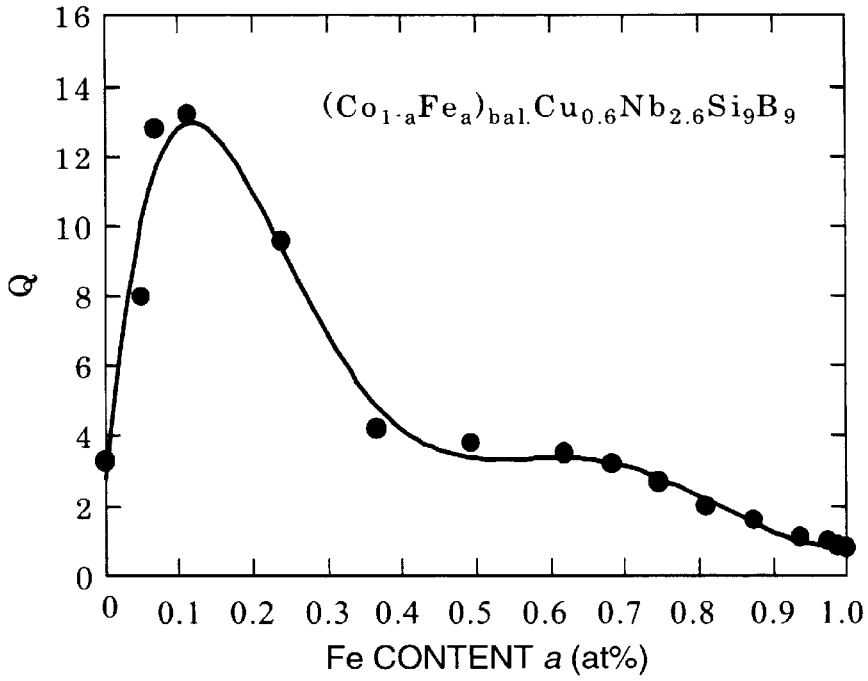
FIG. 6 is a diagram showing Fe content (a) dependence of Q of the invention alloy.

The magnetic alloy core was annealed in accordance with the same heat treatment pattern as that in Example 1, and magnetic properties of the core were measured. The heat-treated alloy were formed fine crystal grains having a grain size of not more than 50 nm. FIG. 4 shows Fe content (a) dependence of a saturation magnetic flux density $B_s$, squareness ratio $B_r/B_{8000}$, and alternating-current relative initial permeability $\mu_{riac}$at 1 kHz. FIG. 5 shows a dependence of an induced magnetic anisotropy constant $K_u$ on the Fe content (a). And FIG. 6 shows Fe content (a)dependence of Q. The magnetic flux density $B_{8000}$ (nearly equal to Bs) at 8000 $Am^{-1}$ is 0.55T or more, and a high value exceeding 1T is obtained with $a \geqq 0.1$. When Fe is contained, the squareness ratio $B_r/B_{8000}$ exhibits a low value of 20% or less. A low squareness ratio is obtained particularly with a=0.1 to 0.35. The relative initial permeability $\mu_{riac}$ decreases with the Fe content, and exhibits a low value of not more than 2000 with $a<0.35$. The constant $K_u$ is remarkably increased in $a<0.35$, and maximized at around a=0.1. The quality factor Q is remarkably increased in $a<0.35$ and exhibits a maximum value of about 13 in around a=0.1.

As described above, a large Q is obtained in $a<0.35$. A particularly large Q is obtained in $a<0.2$.

Example 3

Molten alloys each having a chemical composition shown in Table 2 were rapidly quenched by the single roll method under the atmosphere or an Ar gas atmosphere to obtain thin amorphous alloy strips each having a width of 10 mm and thickness of 15 $\mu$m. The alloys containing active metals such as Zr, Hf were fabricated under an Ar gas atmosphere. The thin amorphous alloy strips were wound into troidal magnetic cores having an outer diameter of 19 mm and an inner diameter of 15 mm. The magnetic alloy cores were subjected to heat treatment in accordance with the heat treatment pattern shown in FIG. 1. During the heat treatment, the magnetic field was applied in the direction perpendicular to the magnetic path of the magnetic core (in the width direction of the thin alloy strip). In the heat-treated alloys, there were formed extremely fine crystal grains having a grain size of not more than 50 nm and having a bcc phase, fcc phase, or hcp phase, respectively. With regard to the heat-treated magnetic alloy cores, the static B-H loop, alternating-current relative initial permeability $\mu_{riac}$ at 1 kHz, and Q at 1 MHz were measured. Table 2 shows the squareness ratio $B_r/B_{8000}$, alternating-current relative initial permeability $\mu_{riac}$ at 1 kHz, Q at 1 MHz, and formed phase. The alloys of the invention have Q of not less than 4 at 1 MHz, and low squareness ratio $B_r/B_{8000}$, and are suitably applied to magnetic core materials of high-frequency choke coils or transformers for use at a high power, core materials for a pulse power, and so on. On the other hand, the nanocrystal-line alloys other than the invention alloys are low in Q at 1 MHz and inferior in properties of the high-frequency range exceeding 1 MHz. The invention alloys have a low magnetic permeability of not more than 2000 on a low-frequency side, indicates the B-H loop which is not easily saturated, and have a high saturation magnetic flux density and satisfactory temperature property as compared with ferrite. Since the invention alloys are not easily saturated magnetically, they are particularly suitable for magnetic members for applications with a large current. Further, because of a high Q in the high frequency range, the invention alloys are suitable for, for example, magnetic cores for antennas.

Example 4

A molten alloy of $(Co_{0.8}Fe_{0.2})_{bal.}Cu_1Nb_3Si_{13.5}B_9$ (atomic %) was rapidly quenched in the single roll method to obtain a thin amorphous alloy strip having a width of 25 mm and thickness of 18 $\mu$m. The thin amorphous alloy strip was wound into troidal magnetic cores having an outer diameter of 25 mm and an inner diameter of 20 mm. The magnetic field was applied in the height direction of the magnetic core (in the width direction of the thin alloy strip) and the magnetic alloy core was subjected to heat treatment in a magnetic field. The heat treatment was performed in accordance with the same heat-treatment pattern as that of Example 1, while the magnetic field was applied to the core through the period. It was confirmed by a transmission electron microscope and X-ray diffraction that there was formed crystal grains in the alloy, which have a grain size of 10 to 20 mm and body-centered cubic structure. According to a result of measurement of the direct-current magnetic property and Q, the squareness ratio $B_r/B_{8000}$ was 1%, and Q was 10. Subsequently, a conductor of a three-phase inverter was passed through the magnetic core window, and a zero-phase reactor for three phases was constituted. For a comparison purpose, a zero-phase reactor using an alloy, which contains formed compounds and was not subjected to the heat treatment under a magnetic field, and a zero-phase reactor for three phases using a conventional Fe-base nanocrystalline alloy ($Fe_{bal.}Cu_1Nb_3Si_{13.5}B_9$ (atomic %)) were prepared, while the both alloys have the same chemical composition. The former conventional alloy had the squareness ratio $B_r/B_{8000}$ of 45% and Q at 1 MHz of 1.5. The latter conventional alloy had the squareness ratio $B_r/B_{8000}$ of 1% and Q at 1 MHz of 0.65. A noise attenuation measured on an inverter circuit was −7 dB at 1 MHz for the zero-phase reactor using the invention alloy, −1.1 dB for the Co-base nano-crystalline alloy formed of the compound phase heat-treated without applying a magnetic field, and −4.5 dB for the zero-phase reactor using the conventional Fe-base nanocrystalline alloy.

Example 5

Molten alloys having chemical compositions shown in Table 3 were rapidly quenched in the single roll method under the atmosphere or an Ar gas atmosphere to obtain a thin amorphous alloy strips each having a width of 10 mm and thickness of 12 $\mu$m. The alloy containing active metals such as Zr, Hf were produced in an Ar gas atmosphere. The thin amorphous alloy strips were wound into troidal magnetic cores having an outer diameter of 19 mm and an inner diameter of 15 mm. The magnetic alloy cores were annealed in accordance with the heat treatment pattern shown in FIG. 1. During the heat treatment, the magnetic field was applied to the cores in the direction of the magnetic path of the magnetic core (in a longitudinal direction of the thin alloy strip). This heat treatment is distinguished from that in Example 3. There were formed fine crystal grains having a grain size of not more than 50 nm in the heat-treated alloy. The static B-H loop of the heat-treated magnetic alloy core, and relative initial permeability $\mu_{riac}$ were measured. Table 3 shows the squareness ratio $B_r/B_{8000}$, relative initial permeability $\mu_{riac}$, and formed phase. The invention alloy has a high squareness ratio or remanence ratio of 85% or more, and a squareness ratio of 90% or more, so that it is suitable for use in magnetic switches for pulse power.

Example 6

Figure 7:
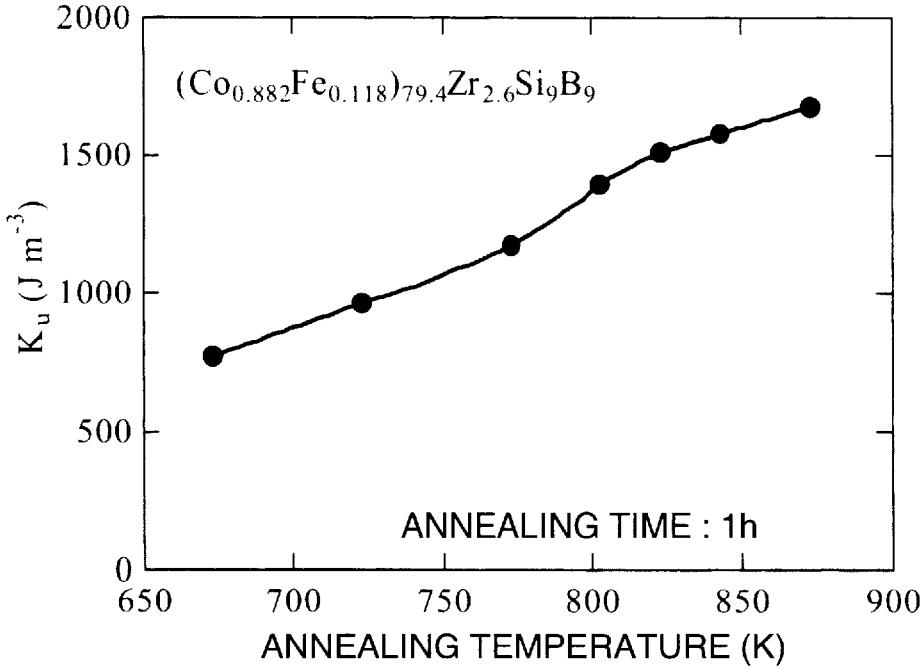
FIG. 7 is a diagram showing a heat treatment temperature dependence of the induced magnetic anisotropy constant $K_u$ for the invention alloy.
Figure 8:
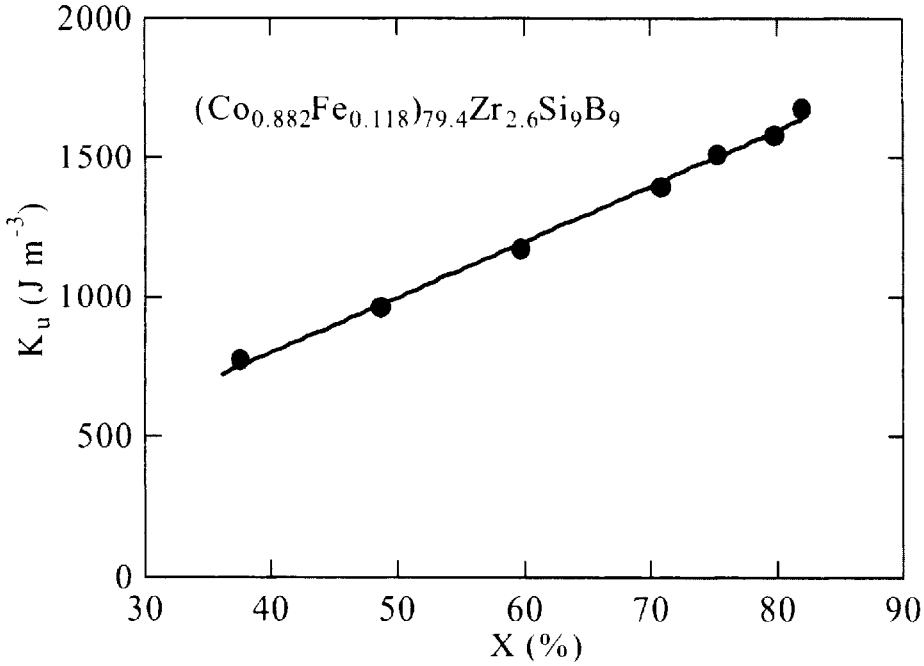
FIG. 8 is a diagram showing a dependence of the induced magnetic anisotropy constant $K_u$ on a crystalline volume fraction X of the invention alloy.

A molten alloy having a composition $Co_{70}Fe_{9.4}Zr_{2.6}Si_9B_9$ was rapidly quenched in the single roll method under an He gas atmosphere to obtain a thin amorphous alloy strip having a width of 5 mm and thickness of 15 $\mu$m. The thin amorphous alloy strip was wound into troidal magnetic cores having an outer diameter of 19 mm and an inner diameter of 15 mm. The magnetic alloy core was annealed in accordance with the heat treatment pattern shown in FIG. 1. During the heat treatment, the magnetic field was applied to the core in the direction perpendicular to the magnetic path of the magnetic core (in the width direction of the thin alloy strip). There were formed micro crystal grains having a grain size of about 8 nm in the heat-treated alloy. The static B-H loop of the heat-treated magnetic alloy core was measured, and the induced magnetic anisotropy constant Ku was determined. Obtained results are shown in FIG. 7. Ku increases with a rise of annealing temperature. A volume fraction X of crystalline phase was estimated and a relationship between $K_u$ and X was plotted. Obtained results is shown in FIG. 8. With the increase of the volume fraction, $K_u$ increases. $K_u$ increases with increasing the volume fraction. It has been seen that the alloy is suitable for the high frequency applications.

Example 7

Figure 9:
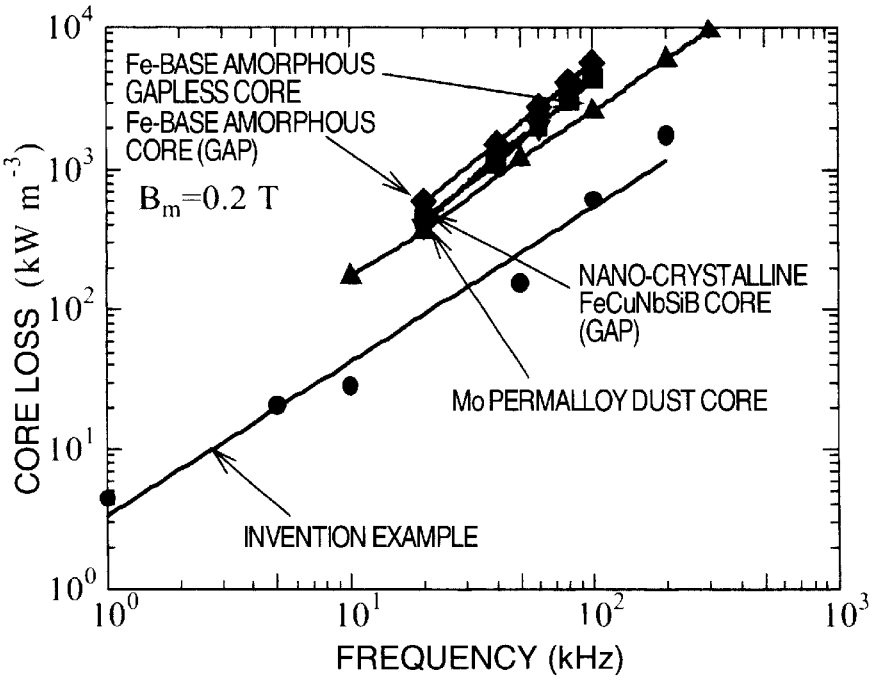
FIG. 9 is a diagram showing frequency dependences of magnetic core losses $P_{cv}$ for a magnetic core made of the invention alloy after heat-treatment and conventional low-permeability magnetic cores for choke coils.
Figure 10:
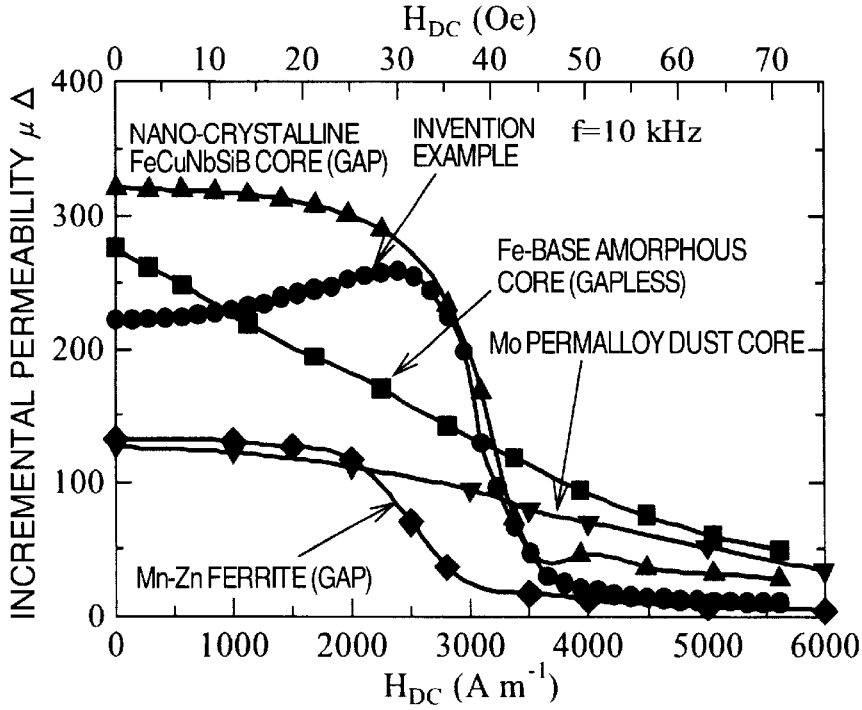
FIG. 10 shows direct-current superimposed characteristics of the magnetic core of the invention alloy and the conventional magnetic core for the choke coil.

A molten alloy having a composition $Co_{70}Fe_{8.8}Cu_{0.6}Zr_{2.6}Si_9B_9$ was rapidly quenched in the single roll method under the He gas atmosphere to obtain a thin amorphous alloy strip having a width of 5 mm and thickness of 18 $\mu$m. The thin amorphous alloy strip was wound into a troidal magnetic core having an outer diameter of 19 mm and an inner diameter of 15 mm. The magnetic alloy core was annealed in accordance with the annealing pattern shown in FIG. 1. During the heat treatment, the magnetic field was applied to the core in the direction perpendicular to the magnetic path of the magnetic core (in the width direction of the thin alloy strip). Fine crystal grains were formed in the heat-treated invention alloy, which have a grain size of about 8 nm and mainly have a bcc phase mainly containing Co, Fe and Si. FIG. 9 shows a frequency dependence of a magnetic core loss $P_{cv}$ for the heat-treated magnetic alloy core of the present invention. For a comparison purpose, FIG. 9 also shows a frequency dependence of the magnetic core loss $P_{cv}$ for the conventional low-permeability magnetic core for the choke coil. The magnetic core of the invention alloy has a remarkably low $P_{cv}$ and is excellent than the conventional magnetic core. FIG. 10 shows direct-current superimposed characteristics of the magnetic core of the invention alloy and the conventional magnetic core for the choke coil. It can be seen that the invention magnetic core has relatively good direct-current superimposed characteristics. The invention alloy has a low magnetic core loss and satisfactory direct-current superimposed characteristics. Further, since it is unnecessary to form a gap, it can be seen that the invention alloy is suitable for choke coils for high frequency.

Figure 11:
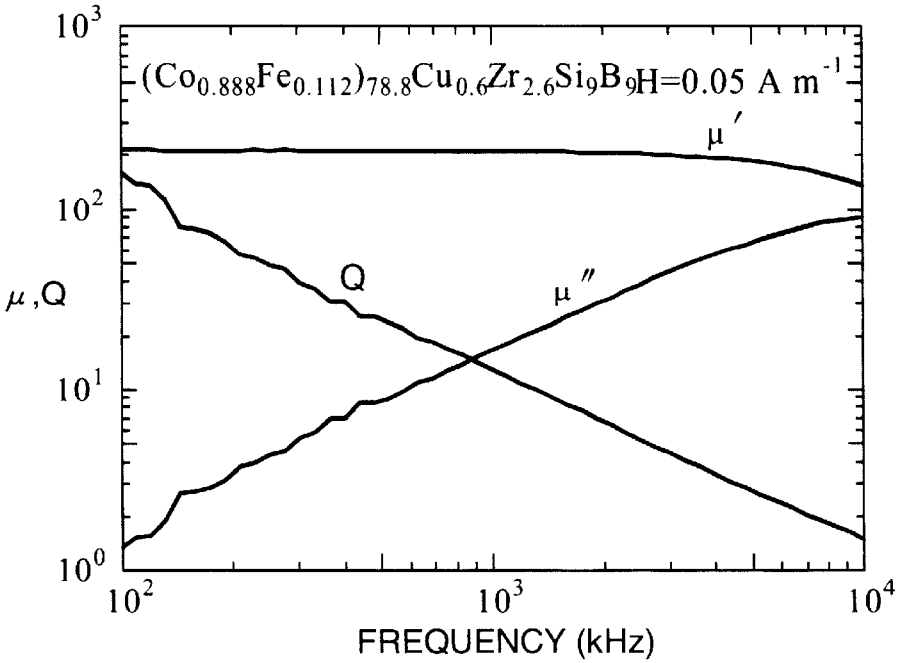
FIG. 11 is a diagram showing frequency dependence of a complex permeability and quality factor Q of the invention alloy.
Figure 12:
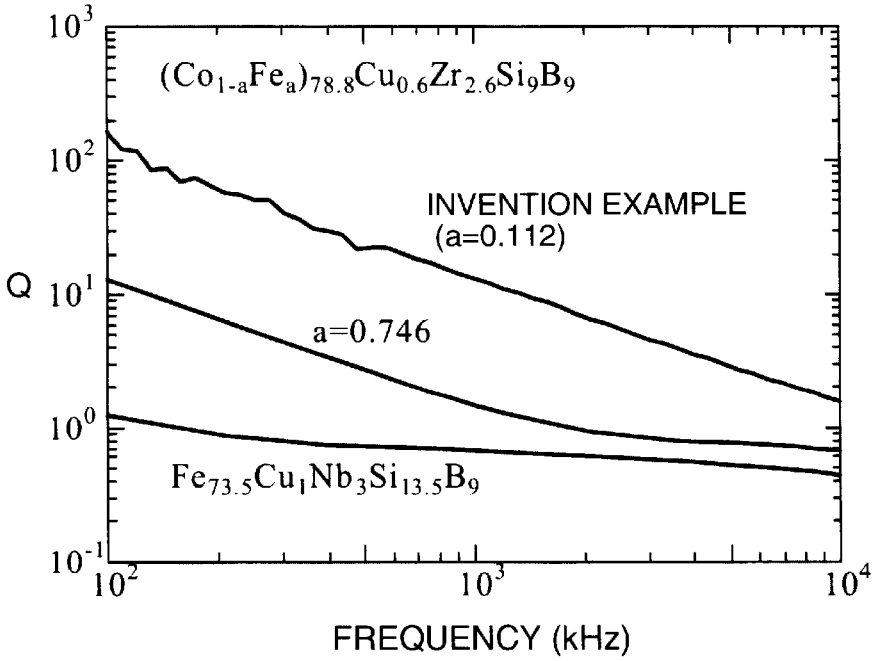
FIG. 12 is a diagram showing frequency dependences of the quality factors Q for the invention alloy and conventional nanocrystalline soft magnetic alloys.

FIG. 11 shows frequency dependence of a complex permeability and quality factor Q. A real part $\mu'$ is substantially constant in several megahertz (MHz), and a frequency at which an imaginary part $\mu''$ shows maximum exceeds 10 MHz, which are excellent in frequency characteristics. In the frequency range, Q monotonously decreases, but exhibits a high value of 10 or more even at 1 MHz. FIG. 12 shows frequency dependence of Q of the invention alloy and a conventional nanocrystalline soft magnetic alloy. The invention alloy is excellent than the conventional nanocrystalline soft magnetic alloy and has a high Q over a 100 kHz to MHz range, and it can be seen that the invention alloy is suitable for members such as antennas and inductors for high frequency.

Further, during heat treatment, the magnetic field is applied to the direction perpendicular to the magnetic path of the magnetic core (in the width direction of the thin alloy strip). Since the heat-treated invention alloy is hard to be saturated, it can be used in members such as current sensors and reactors not only for high frequency range but also for low frequency range (i.e. a commercial frequency range). The invention alloy can also be used in various sensors, and electromagnetic shields.

According to the invention, it is possible to realize a Co-base magnetic alloy suitable for members of countermeasure against noise such as zero phase reactors and electromagnetic shielding materials, inverter transformers, choke coils for active filters, antennas, smoothing choke coils, power supplies for lasers, pulse power magnetic members for accelerators, and so on, and high performance magnetic members made of the Co-base magnetic alloy, so that notable technical advantages can be obtained.

The invention Co-base magnetic alloy has a chemical composition represented by the following general formula, by atomic %: $(Co_{1-a}Fe_a)_{100-y-c}M'_yX'_c$, where M' is at least one element selected from the group consisting of V, Ti, Zr, Nb, Mo, Hf, Sc, Ta and W; X' is at least one element selected from the group consisting of Si and B; and a, y and c satisfy the formulas of $a<0.35$, $1.5 \leqq y \leqq 15$, and $4 \leqq c \leqq 30$, respectively, wherein at least a part of the alloy structure of the Co-base magnetic alloy consists of crystal grains having an average grain size of not more than 50 nm, and the Co-base magnetic alloy has a relative initial permeability of not more than 2000.

Herein below, there will be raised some embodiments of the invention alloy.

(a) The Co-base magnetic alloy as defined directly above, which comprises 4 to 15 atomic % of B (boron).

(b) The Co-base magnetic alloy as defined in above item (a), a part of which alloy structure is an amorphous phase.

(c) The Co-base magnetic alloy as defined in above item (a) or (b), of which alloy structure has no compound phase.

(d) The Co-base magnetic alloy as defined in any one of above items (a) to (c), wherein at least a part of the crystal grains having an average grain size of not more than 50 nm is of a body-centered cubic crystalline structure.

(e) The Co-base magnetic alloy as defined in any one of above items (a) to (d), wherein at least a part of the crystal grains having an average particle size of not more than 50 nm is of a face-centered cubic crystalline structure.

(f) The Co-base magnetic alloy as defined in any one of above items (a) to (e), wherein at least a part of the crystal grains having an average grain size of not more than 50 nm is of a hexagonal crystalline structure.

(g) The Co-base magnetic alloy as defined in any one of above items (a) to (d), wherein the index a is less than 0.2.

(h) The Co-base magnetic alloy as defined in any one of above items (a) to (g), wherein a part of the Co content is replaced with Ni.

(i) The Co-base magnetic alloy as defined in any one of above items (a) to (h), wherein not more than 10 atomic % of a total content of Co and Fe is replaced with at least one element selected from the group consisting of Cu and Au.

(j) The Co-base magnetic alloy as defined in any one of above items (a) to (i), wherein a part of the M' content is replaced with at least one element selected from the group consisting of Cr, Mn, Sn, Zn, In, Ag, platinum group elements, Mg, Ca, Sr, Y, rare earth elements, N, O and S.

(k) The Co-base magnetic alloy as defined in any one of above items (a) to (j), wherein a part of the X' content is replaced with at least one element selected from the group consisting of C, Ge, Ga, Al and P.

(l) The Co-base magnetic alloy as defined in any one of above items (a) to (k), wherein a quality factor Q at 1 MHz is not less than 4, and a squareness ratio $B_r/B_{8000}$ is not more than 20%.

(m) The Co-base magnetic alloy as defined in any one of above items (a) to (l), wherein the squareness ratio $B_r/B_{8000}$ is not less than 85%.

(n) A magnetic member made of the Co-base magnetic alloy as defined in any one of above items (a) to (m).

TABLE 1

| | Composition (Atomic %) | $B_s$ (T) | $B_r B_s^{-1}$ (%) | $\mu_{riac}$ | Q | Pcv ($kWm^{-3}$) |
|---|---|---|---|---|---|---|
| Invention Example | $(Co_{0.81}Fe_{0.19})_{bal.}Cu_1Nb_3Si_{15.5}B_{6.5}$ | 0.97 | 1 | 270 | 18 | 260 |
| Comparative Example | $Fe_{bal.}Cu_1Nb_3Si_{15.5}B_{6.5}$ | 1.23 | 3 | 12000 | 0.60 | 260 |

TABLE 2

| No. | Composition (Atmic %) | $B_{8000}$ (T) | $B_r B_{8000}^{-1}$ (%) | $\mu_{riac}$ | Q | Formed phase |
|---|---|---|---|---|---|---|
| Invention Example | | | | | | |
| 1 | $(Co_{0.85}Fe_{0.15})_{bal.}Cu_1Nb_3Si_9B_9Mn_{0.5}$ | 1.18 | 1 | 250 | 12.2 | bcc + AM |
| 2 | $(Co_{0.82}Fe_{0.18})_{bal.}Cu_2Nb_{2.5}Si_9B_9Ni_{10}$ | 0.97 | 1 | 280 | 11.5 | bcc + AM |
| 3 | $(Co_{0.80}Fe_{0.20})_{bal.}Cu_3Nb_{2.5}Si_{15}B_9$ | 0.98 | 1 | 260 | 12.5 | bcc + AM |
| 4 | $(Co_{0.92}Fe_{0.08})_{bal.}Cu_{1.1}Zr_{2.5}Si_8B_9Al_2O_{0.01}$ | 0.95 | 2 | 180 | 10.9 | bcc + AM |
| 5 | $(Co_{0.94}Fe_{0.06})_{bal.}Hf_7B_7Cr_1$ | 1.30 | 2 | 120 | 8.8 | bcc + AM |
| 6 | $(Co_{0.75}Fe_{0.25})_{bal.}Cu_2Ta_{2.5}Si_9B_{15}Mn_1$ | 0.87 | 1 | 480 | 8.1 | bcc + AM |
| 7 | $(Co_{0.80}Fe_{0.20})_{bal.}Cu_{0.7}Mo_3Si_{11}B_{11}C_1$ | 1.10 | 1 | 310 | 11.6 | bcc + AM |
| 8 | $(Co_{0.80}Fe_{0.20})_{bal.}Cu_{1.6}V_7Si_{11}B_9P_1W_{0.5}Ge_2$ | 0.88 | 1 | 280 | 12.1 | bcc + AM |
| 9 | $(Co_{0.78}Fe_{0.22})_{bal.}Cu_1Nb_4Zr_3B_8$ | 1.25 | 2 | 300 | 11.3 | bcc + AM |
| 10 | $(Co_{0.79}Fe_{0.21})_{bal.}Cu_{0.7}Nb_{2.5}Si_{11}B_{11}Ti_1N_{0.01}$ | 1.19 | 1 | 290 | 11.5 | bcc + AM |
| 11 | $(Co_{0.81}Fe_{0.19})_{bal.}Cu_{0.8}Nb_{2.5}Si_{10}B_{10}Sn_{0.5}$ | 1.17 | 1 | 270 | 11.9 | bcc + AM |
| 12 | $(Co_{0.84}Fe_{0.16})_{bal.}Cu_{0.7}Nb_{2.5}Si_{10}B_{11}Zn_{0.2}S_{0.02}$ | 1.15 | 1 | 250 | 12.7 | bcc + AM |
| 13 | $(Co_{0.83}Fe_{0.17})_{bal.}Cu_1Nb_{2.8}Si_{11}B_9Ni_5Ag_{0.2}$ | 1.05 | 1 | 320 | 12.8 | bcc + AM |
| 14 | $(Co_{0.82}Fe_{0.18})_{bal.}Cu_1Nb_{2.5}Si_{11}B_9In_{0.2}Sm_{0.1}$ | 1.20 | 1 | 330 | 12.7 | bcc + AM |
| 15 | $(Co_{0.80}Fe_{0.20})_{bal.}Cu_{0.7}Nb_{2.5}Si_{11}B_{11}Ni_{10}Pd_2$ | 1.19 | 1 | 310 | 10.8 | bcc + AM |
| 16 | $(Co_{0.80}Fe_{0.20})_{bal.}Au_{0.8}Nb_{2.6}Si_9B_{10}Pt_1Mg_{0.01}$ | 1.08 | 1 | 280 | 10.3 | bcc + AM |
| 17 | $(Co_{0.95}Fe_{0.05})_{bal.}Au_{0.7}Nb_3Si_9B_{10}Ga_{0.5}$ | 0.99 | 1 | 290 | 8.0 | bcc + AM |
| 18 | $(Co_{0.80}Fe_{0.20})_{bal.}Nb_{2.5}Si_{11}B_9Cr_1Ru_{0.5}$ | 1.04 | 2 | 280 | 7.9 | bcc + AM |
| 19 | $(Co_{0.84}Fe_{0.16})_{bal.}Nb_{2.5}Si_9B_{15}Al_1$ | 0.97 | 2 | 310 | 7.8 | bcc + AM |
| 20 | $(Co_{0.98}Fe_{0.02})_{bal.}Zr_{2.5}Si_9B_{8.5}V_1$ | 1.03 | 3 | 270 | 9.3 | hcp + AM |
| 21 | $(Co_{0.94}Fe_{0.06})_{bal.}Zr_7B_6$ | 1.50 | 5 | 1000 | 4.8 | fcc + AM |
| 22 | $(Co_{0.94}Fe_{0.06})_{bal.}Hf_7B_7$ | 1.49 | 7 | 1900 | 4.1 | fcc + AM |
| 23 | $(Co_{0.98}Fe_{0.02})_{bal.}Ti_7B_{10}$ | 1.46 | 6 | 2000 | 4.0 | fcc + hcp + AM |
| 24 | $(Co_{0.99}Fe_{0.01})_{bal.}Nb_7B_9$ | 1.45 | 6 | 180 | 7.4 | fcc + hcp + AM |
| 25 | $(Co_{0.997}Fe_{0.003})_{bal.}Nb_{2.8}Si_9B_{9.5}$ | 0.92 | 7 | 190 | 8.0 | hcp + AM |
| 26 | $(Co_{0.94}Fe_{0.06})_{bal.}Zr_7B_6Ni_{10}$ | 0.85 | 6 | 220 | 8.1 | fcc + AM |
| 27 | $(Co_{0.94}Fe_{0.06})_{bal.}Nb_7B_9Ni_7Pd_5$ | 0.82 | 6 | 220 | 10.9 | bcc + fcc + AM |
| 28 | $(Co_{0.93}Fe_{0.07})_{bal.}Cu_{0.2}Nb_6Si_4B_{10}P_{0.5}$ | 0.98 | 5 | 180 | 9.0 | bcc + hcp + AM |
| Comparative Example | | | | | | |
| 29 | $Fe_{bal.}Cu_1Ta_2Si_{14.5}B_9$ | 1.20 | 7 | 1900 | 0.8 | bcc + AM |
| 30 | $(Fe_{0.8}Ni_{0.2})_{bal.}Cu_1Nb_3Si_9B_9$ | 1.07 | 6 | 5200 | 1.8 | bcc + AM |
| 31 | $(Fe_{0.8}Co_{0.2})_{bal.}Cu_{0.8}Nb_3Si_{13.5}B_9$ | 1.24 | 15 | 4900 | 1.9 | bcc + AM |
| 32 | $Fe_{bal.}Zr_5Nb_2B_9$ | 1.56 | 12 | 1800 | 0.8 | bcc + AM |
| 33 | $Fe_{bal.}Au_{0.7}Nb_{2.5}Mo_{0.5}Si_{16}B_8$ | 1.20 | 15 | 2100 | 0.7 | bcc + AM |
| 34 | $Fe_{bal.}Cu_{0.8}Nb_3Si_{15.5}B_{9.5}$ | 1.23 | 8 | 2200 | 0.7 | bcc + AM |

*AM: Amorphous phase

TABLE 3

| No. | Composition (Atmic %) | $B_r B_{8000}^{-1}$ (%) | $\mu_{riac}$ | Formed phase |
|---|---|---|---|---|
| Invention Example | | | | |
| 35 | $(Co_{0.85}Fe_{0.15})_{bal.}Cu_1Nb_3Si_9B_9Mn_{0.5}$ | 95 | 240 | bcc + AM |
| 36 | $(Co_{0.82}Fe_{0.18})_{bal.}Cu_2Nb_{2.5}Si_9B_9Ni_{10}$ | 96 | 230 | bcc + AM |
| 37 | $(Co_{0.80}Fe_{0.20})_{bal.}Cu_3Nb_{2.5}Si_{15}B_9$ | 96 | 220 | bcc + AM |
| 38 | $(Co_{0.92}Fe_{0.08})_{bal.}Cu_{1.1}Zr_{2.5}Si_8B_9Al_2O_{0.01}$ | 97 | 210 | bcc + AM |
| 39 | $(Co_{0.94}Fe_{0.06})_{bal.}Hf_7B_7Cr_1$ | 98 | 150 | bcc + AM |
| 40 | $(Co_{0.75}Fe_{0.25})_{bal.}Cu_2Ta_{2.5}Si_9B_{15}Mn_1$ | 93 | 260 | bcc + AM |
| 41 | $(Co_{0.80}Fe_{0.20})_{bal.}Cu_{0.7}Mo_3Si_{11}B_{11}C_1$ | 94 | 250 | bcc + AM |
| 42 | $(Co_{0.80}Fe_{0.20})_{bal.}Cu_{1.6}V_7Si_{11}B_9P_1W_{0.5}Ge_2$ | 95 | 240 | bcc + AM |
| 43 | $(Co_{0.78}Fe_{0.22})_{bal.}Cu_1Nb_4Zr_3B_8$ | 94 | 250 | bcc + AM |
| 44 | $(Co_{0.79}Fe_{0.21})_{bal.}Cu_{0.7}Nb_{2.5}Si_{11}B_{11}Ti_1N_{0.01}$ | 95 | 210 | bcc + AM |
| 45 | $(Co_{0.81}Fe_{0.19})_{bal.}Cu_{0.8}Nb_{2.5}Si_{10}B_{10}Sn_{0.5}$ | 96 | 180 | bcc + AM |
| 46 | $(Co_{0.84}Fe_{0.16})_{bal.}Cu_{0.7}Nb_{2.5}Si_{10}B_{11}Zn_{0.2}S_{0.02}$ | 97 | 160 | bcc + AM |
| 47 | $(Co_{0.83}Fe_{0.17})_{bal.}Cu_1Nb_{2.8}Si_{11}B_9Ni_5Ag_{0.2}$ | 96 | 170 | bcc + AM |
| 48 | $(Co_{0.82}Fe_{0.18})_{bal.}Cu_1Nb_{2.5}Si_{11}B_9In_{0.2}Sm_{0.1}$ | 95 | 200 | bcc + AM |
| 49 | $(Co_{0.80}Fe_{0.20})_{bal.}Cu_{0.7}Nb_{2.5}Si_{11}B_{11}Ni_{10}Pd_2$ | 94 | 210 | bcc + AM |
| 50 | $(Co_{0.80}Fe_{0.20})_{bal.}Au_{0.8}Nb_{2.6}Si_9B_{10}Pt_1Mg_{0.01}$ | 95 | 230 | bcc + AM |
| 51 | $(Co_{0.95}Fe_{0.05})_{bal.}Au_{0.7}Nb_3Si_9B_{10}Ga_{0.5}$ | 94 | 250 | bcc + AM |
| 52 | $(Co_{0.80}Fe_{0.20})_{bal.}Nb_{2.5}Si_{11}B_9Cr_1Ru_{0.5}$ | 96 | 200 | bcc + AM |
| 53 | $(Co_{0.84}Fe_{0.16})_{bal.}Nb_{2.5}Si_9B_{15}Al_1$ | 97 | 180 | bcc + AM |
| 54 | $(Co_{0.98}Fe_{0.02})_{bal.}Zr_{2.5}Si_9B_{8.5}V_1$ | 97 | 170 | hcp + AM |
| 55 | $(Co_{0.94}Fe_{0.06})_{bal.}Zr_7B_6$ | 91 | 310 | fcc + AM |
| 56 | $(Co_{0.94}Fe_{0.06})_{bal.}Hf_7B_7$ | 90 | 330 | fcc + AM |
| 57 | $(Co_{0.99}Fe_{0.01})_{bal.}Nb_7B_9$ | 85 | 380 | fcc + hcp + AM |

TABLE 3-continued

| No. | Composition (Atmic %) | $B_r B_{8000}^{-1}$ (%) | $\mu_{riac}$ | Formed phase |
|---|---|---|---|---|
| 58 | $(Co_{0.94}Fe_{0.06})_{bal.}Zr_7B_6Ni_{10}$ | 92 | 260 | fcc + AM |
| 59 | $(Co_{0.93}Fe_{0.07})_{bal.}Cu_{0.2}Nb_6Si_4B_{10}P_{0.5}$ | 93 | 270 | bcc + hcp + AM |
| Comparative Example | | | | |
| 60 | $Fe_{bal.}Cu_1Ta_2Si_{14.5}B_9$ | 83 | 450 | bcc + AM |
| 61 | $(Fe_{0.99}Ni_{0.01})_{bal.}Cu_1Nb_3Si_9B_9$ | 82 | 380 | bcc + AM |
| 62 | $(Fe_{0.99}Co_{0.01})_{bal}Cu_{0.8}Nb_3Si_8B_9$ | 83 | 350 | bcc + AM |
| 63 | $Fe_{bal.}Zr_5Nb_2B_9$ | 84 | 390 | bcc + AM |
| 64 | $Fe_{bal.}Au_{0.7}Nb_{2.5}Mo_{0.8}Si_{17}B_8$ | 84 | 380 | bcc + AM |
| 65 | $Fe_{bal.}Cu_{0.8}Nb_{3.8}Si_{17.5}B_{9.5}$ | 83 | 360 | bcc + AM |

*AM: Amorphous phase

What is claimed is:

1. A Co-base magnetic alloy having a chemical composition represented by the following general formula, by atomic %: $(Co_{1-a}Fe_a)_{100-y-c}M'_yX'_c$, where M' is at least one element selected from the group consisting of V, Ti, Zr, Nb, Mo, Hf, Sc, Ta and W; X' is Si and B; and a, y and c satisfy the formulas of $a<0.35$, $1.5 \leqq y \leqq 15$, and $4 \leqq c \leqq 30$, respectively, wherein the amount of B is from 4 atomic % to 10 atomic %, and wherein:

at least a part of the alloy structure of the Co-base magnetic alloy consists of crystal grains having an average grain size of not more than 50 nm, the Co-base magnetic alloy has a relative initial permeability of not more than 2000, and a quality factor Q at 1 MHz is not less than 4.

2. A Co-base magnetic alloy according to claim 1, a part of which alloy structure is an amorphous phase.

3. A Co-base magnetic alloy according to claim 1, of which alloy structure has no compound phase.

4. A Co-base magnetic alloy according to claim 1, wherein at least a part of the crystal grains having an average grain size of not more than 50 nm is of a body-centered cubic crystalline structure.

5. A Co-base magnetic alloy according to claim 1, wherein at least a part of the crystal grains having an average particle size of not more than 50 nm is of a face-centered cubic crystalline structure.

6. A Co-base magnetic alloy according to claim 1, wherein at least a part of the crystal grains having an average grain size of not more than 50 nm is of a hexagonal crystalline structure.

7. A Co-base magnetic alloy according to claim 1, wherein the index a is less than 0.2.

8. A Co-base magnetic alloy according to claim 1, wherein a part of the Co content is replaced with Ni.

9. A Co-base magnetic alloy according to claim 1, wherein not more than 10 atomic % of a total content of Co and Fe is replaced with at least one element selected from the group consisting of Cu and Au.

10. A Co-base magnetic alloy according to claim 1, wherein a part of the M' content is replaced with at least one element selected from the group consisting of Cr, Mn, Sn, Zn, In, Ag, platinum group elements, Mg, Ca, Sr, Y, rare earth elements, N, O and S.

11. A Co-base magnetic alloy according to claim 1, wherein a part of the X' content is replaced with at least one element selected from the group consisting of C, Ge, Ga, Al and P.

12. A Co-base magnetic alloy according to claim 1, wherein a and a squareness ratio $B_r/B_{8000}$ is not more than 20%.

13. A Co-base magnetic alloy according to claim 1, wherein the squareness ratio $B_r/B_{8000}$ is not less than 85%.

14. A magnetic member made of the Co-base magnetic alloy as defined in claim 1.

* * * * *